United States Patent [19]

Koike et al.

[11] 4,402,884

[45] Sep. 6, 1983

[54] METHOD FOR PRODUCING FERRO-NICKEL SHOTS

[75] Inventors: Shinkichi Koike; Akira Kimura; Toru Hikage; Sadao Sugiura, all of Hachinoheshi, Japan

[73] Assignee: Pacific Metals Co., Ltd., Tokyo, Japan

[21] Appl. No.: 269,659

[22] Filed: Jun. 2, 1981

Related U.S. Application Data

[63] Continuation of Ser. No. 81,815, Oct. 4, 1979, abandoned.

[30] Foreign Application Priority Data

Oct. 4, 1978 [JP] Japan ..... 53-121436

[51] Int. Cl.[3] ..... B29C 23/00

[52] U.S. Cl. ..... 264/8; 75/0.5 C; 75/123 N; 75/123 K; 420/459

[58] Field of Search ..... 75/0.5 C, 0.5 BA, 0.5 BB, 75/123 R, 123 N, 128 R, 134 M, 170, 171; 264/5–13; 420/459

[56] References Cited

U.S. PATENT DOCUMENTS

| | | | |
|---|---|---|---|
| Re. 23,538 | 8/1952 | Hoacox et al. | 264/8 |
| 1,680,058 | 8/1928 | Merica | 75/123 K |
| 2,863,790 | 12/1958 | Chen | 75/123 N |
| 4,192,673 | 3/1980 | Baba | 75/0.5 C |
| 4,274,940 | 6/1981 | Plancqueel et al. | 75/251 |

FOREIGN PATENT DOCUMENTS

| | | |
|---|---|---|
| 2211682 | 9/1973 | Fed. Rep. of Germany . |
| 2636550 | 2/1977 | Fed. Rep. of Germany . |

OTHER PUBLICATIONS

Hodkin, D. J.; "Centrifugal Shot Casting", *Powder Metallurgy,* vol. 16, No. 32, pp. 277–313, (1973).

*Alloy Cast Irons,* 2nd Edition, Am. Foundrymen's Assoc., Chicago, Ill., pp. 229–231.

*Primary Examiner*—Michael L. Lewis

*Attorney, Agent, or Firm*—Wenderoth, Lind & Ponack

[57] ABSTRACT

A method for producing ferro-nickel shots which comprises adding a manganese source to molten ferro-nickel, pouring the molten ferro-nickel containing manganese onto a rotating disc to granulate the molten ferro-nickel stream, and cooling the granules thus obtained in water.

2 Claims, 9 Drawing Figures

METHOD FOR PRODUCING FERRO-NICKEL SHOTS

This is a continuation application of U.S. application Ser. No. 81,815, filed Oct. 4, 1979, now abandoned.

BACKGROUND OF THE INVENTION

1. Field of the Invention

The present invention relates to a method for producing ferro-nickel shots, more particularly to a method for easy and rapid mass-production of smooth ferro-nickel shots of a large diameter having a flat-disc or granular shape and containing no water, which method comprises adding manganese to molten ferro-nickel and pouring the molten ferro-nickel containing the added manganese onto a rotating disc to divide and granulate the molten metal, and cooling and solidifying the granules to obtain the shots.

2. Description of the Prior Art

As is well known, ferro-nickel is widely used for production of austenitic stainless steels. The ferro-nickel used for this purpose is usually in the form of ingots similar in shape to cold pig iron ingots and weighing about 100 kg each. In recent years, however, secondary steel making processes, such as the AOD process (Argon-Oxygen-Decarburization process) have come into wide use in the production of stainless steels and steel making operations have been automated in various aspects. The conventional ferro-nickel ingot is not well adopted to these new methods and automated operations because it presents problems in handling and in adjustment of the molten steel composition. As a consequence, a demand has arisen for ferro-nickel in the form of shots or pellets of small diameter.

Conventional methods for production of shots or pellets of metals having high a melting point, such as ferro-nickel, include one in which a jet stream of high pressure fluid, such as air or water, is brought into collision with a molten metal stream to disperse the stream into granules or shots, and another in which a molten metal stream is poured onto a fixed plate to disperse the stream into granules or shots.

The metal slots obtained by the prior art methods very often contain water which becomes unavoidably incorporated therein during the cooling and solidification step. Moreover, the conventional shots lack roundness and are very irregular in shape. In the case of shots produced from a molten metal having high viscosity and small surface tension, such as molten high-carbon ferro-nickel, the shots obtained are exceedingly small in diameter and of flat or needle-like configuration but very irregular in shape. Even if large diameter shots with good roundness could be obtained by the conventional methods there would still be the problem of inner voids.

The main disadvantages of the ferro-nickel shots obtained by the conventional methods can be summarized as follows:

(1) The shots are irregular in shape and have numerous protrusions so that they are susceptible to bridging and are apt to cause clogging while being fed into a steel making furnace with the bunker in which they are stored.

(2) The shots vary greatly in size and, at any rate, are so small that when added to the molten metal, they become suspended in the slag and dispersed into the exhaust gas. As a result, production yields are low.

(3) As the shots very often contain water, there is a danger that they may cause steam explosions when added to the molten metal during the steel making operation.

SUMMARY OF THE INVENTION

It is the object of the present invention to overcome the above-mentioned disadvantages of the prior art by adding manganese to molten ferro-nickel and pouring the molten metal onto a rotating disc to disperse the molten metal into granules.

DETAILED DESCRIPTION OF THE INVENTION

Figure 1:
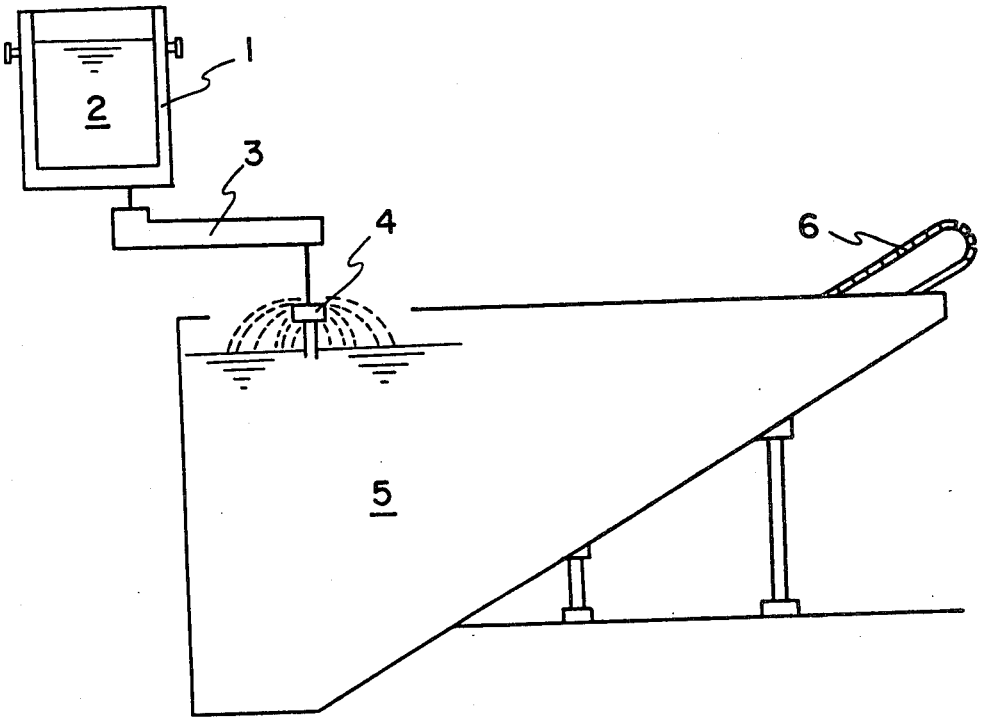
FIG. 1 is a side view of an apparatus for carrying out the method according to the present invention.

The present invention will now be described in detail with reference to the attached drawings.

The present invention have found that the physical properties of the molten ferro-nickel are a most important factor in the production of smooth ferro-nickel shots having a relatively large diameter in a flat-disc or granular shape without surface protrusion and containing no water. More specifically, we have found that in order to produce shots having these desired qualities it is essential to increase the surface tension of the molten metal, to lower its viscosity and to subject it to sufficient deoxidation and degassing.

It is well known that the physical properties of a molten metal can be changed by the addition of various elements thereto and that as elements for effectively deoxidizing and degassing molten ferro-nickel, Mn, Si, Ca, Al, Mg, Ti, etc. are effective.

The present inventors have conducted extensive studies and found that manganese is the most effective element for modification of the physical properties of molten ferro-nickel in the most favourable way for production of ferro-nickel shots. The properties of manganese that make it effective for this purpose are as follows:

(1) It has deoxidizing and degassing effect;

(2) It effectively increases the surface tension and lowers the viscosity of molten ferro-nickel;

(3) It has no adverse effect on the production of stainless steels where chiefly ferro-nickel is used; and (4) It is readily available at low prices.

Si and Al are also readily available at relatively low prices, but these elements are not sufficient in their ability to improve surface tension and viscosity. On the other hand, Ca, Mg. Ti, etc. are not only expensive but have an adverse effect on the final stainless steel products.

As the manganese source, metallic manganese, ferro-manganese, ferro-silicon-manganese and the like may be employed.

According to the present invention, the molten ferro-nickel to which manganese is added is poured in a stream onto a rotating disc to granulate the molten metal stream and the molten granules are cooled and solidified in water to obtain ferro-nickel shots.

Ferro-nickel is classified as being high-carbon grade or low-carbon grade, and ferro-nickels of various chemical compositions are produced for specific applications. In the case of low-carbon ferro-nickel, shots of satisfactory quality can be obtained without full deoxidation and degassing during the manufacturing process because the surface tension and viscosity of a molten high carbon ferro-nickel are relatively suited for granulation.

However, in order to obtain shots having the surface condition, internal qualities and the size characteristics described above, namely in order to consistently obtain ferro-nickel shots having a smooth surface without protrusions, containing no water, having a relatively large diameter with the particle size distribution concentrated in a relatively narror range, the addition of manganese is desirable and effective also in the case of low-carbon ferro-nickel.

In the case of high-carbon ferro-nickel, the viscosity of the molten metal is high and the surface tension is small, so that the addition of manganese produces a remarkable improvement on the physical properties of the molten metal. Particularly in the case of a high-carbon ferro-nickel containing 0.8% or more of C and 0.1% or more of Si, the addition of manganese is indespensable for obtaining the desired qualities of ferro-nickel shots as mentioned before. In this case, it is desirable to add at least 0.2% manganese to the molten ferro-nickel in order to obtain high-carbon ferro-nickel shot with excellent qualities.

When manganese is added to molten ferro-nickel as in the present invention, the quality of shots obtained is somewhat improved even when conventional methods, such as the water granulation method or the method using a fixed plate mentioned earlier, are used. This is because the physical properties of the molten metal can be improved by the mere addition of manganese. However, in order to further improve the quality of the shots, it is necessary to employ a rotating disc. When a rotating disc is employed, the kinetic energy of the falling stream of molten ferro-nickel and the centrifugal force of the rotating disc combine to produce a synergistic effect, whereby ferro-nickel shots having the desired particle diameter can be obtained even from a molten high-carbon ferro-nickel having high viscosity and low surface tension. Moreover, the use of a rotating disc makes it possible to control the shot shape and the particle distribution rapidly and easily merely by properly selecting the flow rate of the molten ferro-nickel, the shape of the rotating disc and its rotation speed.

The rotating disc is circular in shape and the upper surface onto which the stream of molten ferro-nickel containing manganese is poured can be concave, convex or flat but a concave surface is particularly preferable from the point of easy control. The flow rate of the falling stream of molten ferro-nickel is preferably between 500 and 2000 kg/min, more preferably between 800~1500 kg/min, and the rotation speed of the rotating disc is preferably between 100 and 1500 r.p.m., more preferably between 200 and 800 r.p.m.

In the present invention, the amount of manganese to be added to the molten ferro-nickel is preferably at least 0.2% in the case of a high-carbon ferro-nickel containing 0.8% or more of C and 0.1% or more of Si. Although there is no particular upper limit on the amount of manganese added to such a ferro-nickel, the addition of extremely large amounts does not result in a proportional improvement in shot production. Therefore, from the economic point of view and operational considerations in the steel making process, it is desirable to maintain the manganese addition in a range of from 0.2% to 1.5%. On the other hand, in the case of high-carbon ferro-nickels containing less than 0.8% C and less than 0.1% Si and in the case of low-carbon ferro-nickels, the manganese addition can be less than 0.2%.

As mentioned above, when a manganese source is added to molten ferro-nickel and the molten metal containing manganese is granulated according to the present invention, it is possible to obtain high-quality ferro-nickel shots in a flat-disc or granular shape having a smooth surface without protrusions, containing no internal water, and having a large particle diameter with a particle size distribution limited within a very narrow range.

The ferro-nickel shots produced by the present invention can, for example, be continuously or intermittently charged into a ladle or an AOD furnace in a stainless steel production line in a desired amount ranging from several kilograms to several tons and the charging can be carried out automatically with a high degree of accuracy in weight measurement. The shots produced by the method of this invention contains no water and therefore present no danger of steam explosion or the like when charged into the molten metal. Further, as the shots produced by the present invention are large in diameter and have a very narrow particle size distribution, they are rapidly melted into the molten metal without becoming suspended in the molten slag or dispersed into the exhaust gas. As a result, the ferro-nickel shots produced according to the present invention show a very high melting yield and make it possible to easily and rapidly control the composition and temperature of the molten metal.

As will be clearly understood from the foregoing description, the present invention has remarkable technical and economic advantages.

The present invention will now be described in more detail with reference to preferred embodiments.

EXAMPLE 1

15 tons of molten low-carbon ferro-nickel containing 0.09% manganese prepared by adding ferro-manganese to molten ferro-nickel was placed in a ladle 1 (FIG. 1) at 1550° C. and was then poured in a stream onto a disc 4 rotating at 700 r.p.m. to granulate the molten stream in the air. The molten granules were allowed to drop into a body of water the surface of which was about 1,000 mm below the upper surface of the disc. The granules were cooled and solidified by the water to form shots having the following size distribution.

| More than | Less than | % of total |
|---|---|---|
| — | 5 mm | 17.6% |
| 5 mm | 10 mm | 69.5% |
| 10 mm | 15 mm | 12.5% |
| 15 mm | 20 mm | 0.4% |

Figure 2:
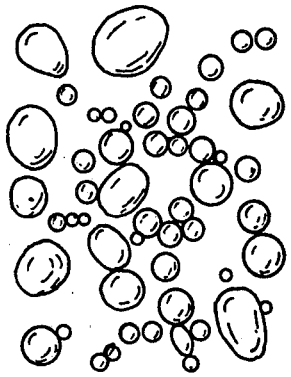
FIG. 2 show low-carbon ferro-nickel shots produced by the present invention.

The shape of the shots is shown in FIG. 2.

The shots were of flat round disc shape, flat oval disc shape and granular shape, and all had smooth surfaces and a metallic luster.

Shots randomly selected from samples prepared by a systematic sampling method were cut to inspect the interiors. The inspection revealed no voids or water inside the shots.

Figure 3:
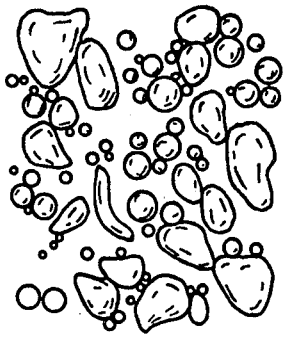
FIG. 3 shows low-carbon ferro-nickel shots produced without addition of manganese.
Figure 4:
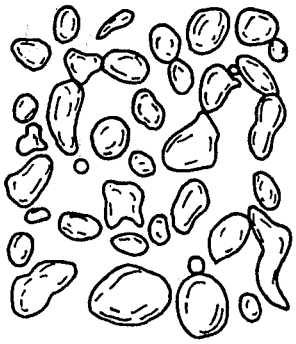
FIG. 4 shows low-carbon ferro-nickel shots produced by water granulation without addition of manganese.

For comparison, molten low-carbon ferro-nickel without addition of manganese was granulated by the same apparatus under the same conditions as in the above example of the present invention, and also by the conventional water granulation method. The shapes of the shots obtained are shown in FIGS. 3 and 4, respectively.

The size distribution and chemical composition of the shots obtained by this invention and of those obtained by the comparative examples are shown in Tables 1 and 2.

The results show that the shots produced according to the present invention are of better quality, are more rounded and have less scattering in size than the comparative shots produced without manganese addition either with the apparatus used in the present invention or by the water granulation method.

EXAMPLE 2

Figure 5:
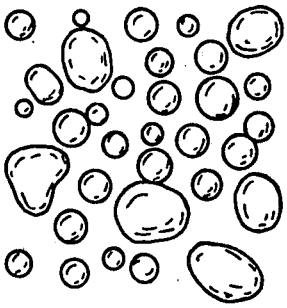
FIG. 5 shows high-carbon ferro-nickel shots containing 0.22% manganese produced according to the present invention.
Figure 6:
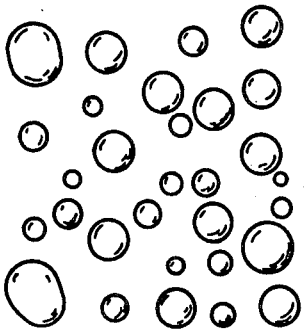
FIG. 6 shows high-carbon ferro-nickel shots containing 0.55% manganese produced according to the present invention.
Figure 7:
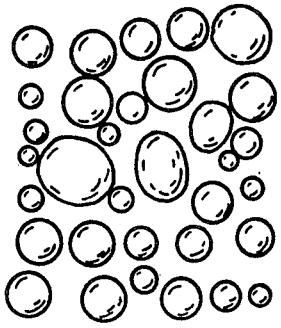
FIG. 7 shows high-carbon ferro-nickel shots containing 1.46% manganese produced according to the present invention.

Three samples of molten high-carbon ferro-nickel containing 0.22% manganese (Example 2-1), 0.55% manganese (Example 2-2) and 1.46% manganese (Example 2-3) respectively were prepared by adding ferro-manganese to molten ferro-nickel. Each sample was placed in a ladle 1 and poured to fall under its own weight onto a disc 4 rotating at 500 r.p.m. The granules produced in this way were allowed to drop into a body of water the surface of which was 1,000 mm below the upper surface of the disc. The granules were cooled and solidified by the water to produce shots having size distributions and compositions as shown in Tables 3 and 4. The shapes of these shots are shown in FIGS. 5, 6 and 7, respectively.

Figure 8:
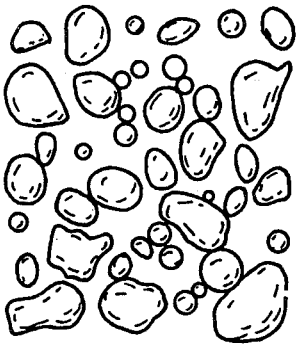
FIG. 8 shows high-carbon ferro-nickel shots containing no manganese.
Figure 9:
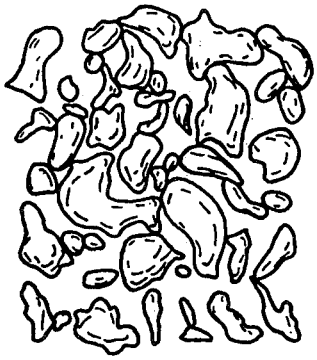
FIG. 9 shows high-carbon ferro-nickel shots produced by water granulation without addition of manganese.

For comparison, molten high-carbon ferro-nickel without manganese addition was granulated with the same apparatus under the same conditions as in the above examples of the present invention, and also by the water granulation method. The size distribution and composition of the shots thus obtained are shown in Tables 3 and 4 (Comparative Examples 3 and 4). The shapes of the shots are shown in FIGS. 8 and 9, respectively.

Similarly to the shots of Example 1, the shots obtained in Example 2 were of flat-disc shape and granular shape, had smooth surfaces with a metallic luster, and fell within a narrow range of size distribution. Also it was confirmed by inspection of the interiors of the shots by the same method as in Example 1 that no voids or water were contained in the shots produced according to the present invention.

TABLE 1

| | | | Particle Size Distribution of the Shots (%) | | | | | | |
|---|---|---|---|---|---|---|---|---|---|
| | | | Less than 5mm | 5~10mm | 10~15mm | 15~20mm | More than 20mm | Total | |
| Example 1 | Mn addition | Rotating disc | 17.6 | 69.5 | 12.5 | 0.4 | 0 | 100 | FIG. 2 |
| Comparative Example 1 | No Mn addition | Rotating disc | 23.1 | 67.7 | 9.2 | 0 | 0 | 100 | FIG. 3 |
| Comparative Example 2 | No Mn addition | Water granulation | 24.5 | 40.5 | 31.1 | 3.6 | 0.3 | 100 | FIG. 4 |

TABLE 2

| | Chemical Composition of Shots (%) | | | | | |
|---|---|---|---|---|---|---|
| | Ni | C | Si | Mn | P | S |
| Example 1 | 53.76 | 0.016 | 0.038 | 0.09 | 0.001 | 0.006 |
| Comparative Example 1 | 53.26 | 0.014 | 0.042 | tr | 0.001 | 0.006 |
| Comparative Example 2 | 53.82 | 0.016 | 0.037 | tr | 0.001 | 0.008 |

TABLE 3

| | | | Particle Size Distribution of the Shots (%) | | | | | | |
|---|---|---|---|---|---|---|---|---|---|
| | | | Less than 5mm | 5~10mm | 10~15mm | 15~20mm | More than 20mm | Total | |
| Example 2-1 | Mn addition | Rotating disc | 7.5 | 62.9 | 24.3 | 4.6 | 0.7 | 100 | FIG. 5 |
| Example 2-2 | Mn addition | Rotating Disc | 5.8 | 56.5 | 34.5 | 2.4 | 0.8 | 100 | FIG. 6 |
| Example 2-3 | Mn addition | Rotating disc | 5.5 | 51.5 | 33.8 | 6.2 | 3.0 | 100 | FIG. 7 |
| Comparative Example 3 | No Mn addition | Rotating disc | 10.6 | 55.9 | 31.1 | 2.8 | 0 | 100 | FIG. 8 |
| Comparative Example 4 | No Mn addition | Water granulation | 12.9 | 31.4 | 18.3 | 23.6 | 13.8 | 100 | FIG. 9 |

TABLE 4

| | Chemical Composition of Shots (%) | | | | | |
|---|---|---|---|---|---|---|
| | Ni | C | Si | Mn | P | S |
| Example 2-1 | 21.56 | 1.68 | 0.60 | 0.22 | 0.018 | 0.009 |
| Example 2-2 | 22.19 | 1.74 | 0.62 | 0.55 | 0.019 | 0.013 |
| Example 2-3 | 21.93 | 1.60 | 0.74 | 1.46 | 0.019 | 0.007 |
| Comparative Example 3 | 22.00 | 1.64 | 0.73 | 0.03 | 0.016 | 0.008 |
| Comparative Example 4 | 21.71 | 1.67 | 0.63 | 0.02 | 0.019 | 0.008 |

What is claimed is:

1. A method for producing ferro-nickel shots which comprises pouring a molten metal alloy consisting essentially of molten ferro-nickel containing 0.2 to 1.5% of Mn, 0.8% or more of C and 0.1% or more of Si onto a rotating disc to divide and granulate the molten ferro-nickel stream, and cooling the granules thus-produced in water to obtain smooth ferro-nickel shots of a flat-disc or granular shape containing substantially no water, said stream of molten ferro-nickel falling at a rate between 500 and 2000 kg/min, and wherein the rotational speed of the rotating disc is between 100 and 1500 r.p.m., and wherein the kinetic energy of the falling stream and the centrifugal force of the rotating disc combine to form shots of a desired and substantially uniform diameter.

2. A method according to claim 1 in which the falling stream of molten ferro-nickel is between 800 and 1500 kg/min and the rotation speed of the rotating disc is between 200 and 800 r.p.m.

* * * * *